US006062684A

United States Patent [19]

Sasaki

[11] Patent Number: 6,062,684

[45] Date of Patent: May 16, 2000

[54] INK CARTRIDGE

[75] Inventor: Toyonori Sasaki, Anjo, Japan

[73] Assignee: Brother Kogyo Kabushiki Kaisha, Nagoya, Japan

[21] Appl. No.: 08/982,581

[22] Filed: Dec. 2, 1997

[30] Foreign Application Priority Data

Jan. 13, 1997 [JP] Japan ..... 9-017312

[51] Int. Cl.[7] ..... B41J 2/175

[52] U.S. Cl. ..... 347/93

[58] Field of Search ..... 347/85, 86, 87, 347/93

[56] References Cited

U.S. PATENT DOCUMENTS

| | | | |
|---|---|---|---|
| 5,509,140 | 4/1996 | Koitabashi et al. | 347/86 |
| 5,721,577 | 2/1998 | Ostermeier et al. | 347/86 |
| 5,821,965 | 10/1998 | Oda et al. | 347/86 |

FOREIGN PATENT DOCUMENTS

| | | |
|---|---|---|
| 631874 | 1/1995 | European Pat. Off. . |
| 6-238908 | 8/1994 | Japan . |
| 6-255122 | 9/1994 | Japan . |

*Primary Examiner*—Huan Tran
*Assistant Examiner*—Michael Nghiem
*Attorney, Agent, or Firm*—Oliff & Berridge, PLC

[57] ABSTRACT

An ink cartridge includes an ink cartridge case having an ink chamber containing ink and a foam chamber containing a porous member impregnated with ink. An ink supply hole formed in the ink chamber is provided with a filter having fine pores whose mesh is smaller than that of the cell pores of the porous member. The filter is mounted into the ink supply hole from outside the cartridge case, and fixed by an adapter. The filter prevents ink leakage during connection of the ink cartridge to an ink introducing portion of a recording head due to surface tension in a meniscus of the ink formed in fine pores of the filter. Ink flows through the filter toward the recording head when the ink cartridge is connected to the recording head because the surface tension in the ink in each fine pore of the filter is destroyed during connection.

18 Claims, 6 Drawing Sheets

INK CARTRIDGE

BACKGROUND OF THE INVENTION

1. Field of Invention

The invention relates to an ink cartridge for supplying ink to a recording head. In particular, the invention relates to an ink cartridge capable of preventing ink leakage from an ink supply hole by providing a filter in the ink supply hole.

2. Description of Related Art

Various conventional ink cartridges for supplying ink to a recording head of an ink jet recording apparatus are known. For example, an ink cartridge including a porous member impregnated with ink and contained in a cartridge case is known, and an ink cartridge wherein the interior of a cartridge case is divided into an ink chamber containing ink and a foam chamber containing a porous member impregnated with ink is also generally known.

U.S. Pat. No. 5,509,140 discloses an ink cartridge having an ink chamber and foam chamber wherein an ink supply hole is formed in the foam chamber-side portion of the cartridge case. Japanese Unexamined Patent Publication Nos. Hei 6-238908 and Hei 6-255122 disclose an ink cartridge having an ink chamber and a foam chamber wherein an ink supply hole is formed in the ink chamber-side portion of the cartridge case.

In the ink chamber disclosed in U.S. Pat. No. 5,509,140, a portion of a porous member near an ink supply hole elastically deforms to provide clearance for a joint member when the joint member protruding from a side of a recording head is inserted into the ink supply hole. A filter provided at an end of the joint member is pressed against the porous member so that an amount of ink impregnating the porous member can be supplied to the recording head. In addition to the ink supply hole, an atmosphere communicating hole is provided in the foam chamber-side portion of the ink cartridge. When the amount of ink impregnating the porous member in the foam chamber for supplying ink to the recording head decreases, the porous member is replenished with an amount of ink from the ink chamber. A negative pressure caused in the ink chamber by the supply of ink into the foam chamber is offset by air introduced into the ink chamber through the atmosphere communicating hole.

Japanese Unexamined Patent Publication No. Hei 6-238908 discloses an ink cartridge in which an elastic seal member is provided at an end portion of the ink supply hole. A filter for filtering debris, dust particles or similar material from the ink is provided in an ink passage formed in a partition that separates an ink chamber and a foam chamber. When the ink cartridge is set into a holder, a hollow needle protruding from a recording head side of the holder penetrates an elastic seal member in the ink cartridge and enters a supply hole to supply ink from the ink chamber to the recording head. When the amount of ink in the ink chamber decreases, the ink chamber is replenished with an amount of ink from the impregnated porous member provided in the foam chamber. A negative pressure caused in the foam chamber by the supply of ink into the ink chamber is offset by air introduced into the foam chamber through an atmosphere communicating hole.

Japanese Unexamined Patent Publication No. Hei 6-255122 discloses an ink cartridge in which an ink supply hole is formed in a lower portion of the ink chamber in a cartridge case. A filter is provided at an ink chamber-side end of an ink supply hole. An ink jet recording head communicating with the ink supply hole is firmly connected to or formed together with a lower portion of the cartridge case. The ink cartridge can be used with an ink jet recording apparatus that ejects ink downwardly to record on a recording medium.

A number of problems and disadvantages are present in the related art devices. In particular, in U.S. Pat. No. 5,509,140, ink is held in the porous member and does not leak even if the ink supply hole is directed downward while the ink cartridge is being attached to the recording head. However, if a wall of the ink cartridge is strongly pressed while the ink cartridge is being attached to the recording head, the porous member compresses and may leak ink from the ink supply hole, thereby staining the exterior or interior of the recording apparatus.

In Japanese Unexamined Patent Publication No. Hei 6-238908, it is necessary to fix the filter to the partition inside the cartridge case during manufacture of the ink cartridge. The fixation of the filter requires a great amount of labor because welding of the metal filter and the synthetic resin partition is very difficult.

Due to the provision of the elastic seal member at the ink supply hole in addition to the filter, the number of component members is great and the structure is complicated. Accordingly, production cost is considerably increased.

Further, it is difficult to attach and detach the ink cartridge to and from the holder because the hollow needle protruding from the recording head side of the holder must be aligned with and penetrate through the elastic seal member.

In Japanese Unexamined Patent Publication No. Hei 6-255122, the ink cartridge and the recording head are firmly connected or formed together. Accordingly, there is no consideration of preventing ink leakage as would be expected if the ink cartridge were detachable from the recording head.

In addition, during manufacture of the ink cartridge, the filter must be fixed to an ink chamber-side portion of the ink supply hole by placing it thereto from the inside of the cartridge case. Because it is difficult to weld the metal filter and the synthetic resin cartridge case, mounting the filter is difficult.

The industry lacks an inexpensive, easily manufactured ink cartridge that is detachable and easily replaceable and does not leak during replacement.

SUMMARY OF THE INVENTION

An object of the invention is to reliably prevent ink leakage from an ink supply hole of an ink cartridge and to simplify the structure of the ink cartridge by facilitating the mounting of a filter during manufacture of the ink cartridge. Another object of the invention is to reduce the cost of producing the ink cartridge by reducing the number of its component members. Yet another object of the invention is to facilitate the mounting and removal of the ink cartridge to and from its holder.

According to an aspect of the invention, an ink cartridge is provided that is detachably mountable to a holder having an ink introducing portion for introducing ink into a recording head. The ink cartridge includes a cartridge case having an ink chamber for holding ink, a foam chamber holding a porous member impregnated with ink, and an ink passage for communication between the ink chamber and the foam chamber. An ink supply hole for supplying ink into the ink introducing portion of the holder is formed in the ink chamber of the cartridge case. An atmosphere communicating hole is provided for allowing the foam chamber of the cartridge case to communicate with the atmosphere. A filter is provided in the ink supply hole.

The cartridge case may be formed of a synthetic resin and the porous member may be formed of a sponge having continuous pores. The filter may be formed of a metal such as stainless steel or similar material.

When the ink cartridge is detached from the holder, an end surface of the filter opposite from the surface thereof facing the ink chamber is exposed to the atmosphere. Surface tension occurs and forms a meniscus (a curved liquid surface) in an ink surface portion in each of the many fine pores of the filter. Therefore, leakage of ink from the ink chamber to the outside through the filter and the ink supply hole is prevented. Even if a side surface portion of the cartridge case is pressed to cause the interior of the cartridge case to be pressurized, the filter is able to substantially prevent the leakage of ink. Furthermore, entrance of external air into the ink chamber through the filter and the ink supply hole is prevented even if a negative pressure occurs in the cartridge case.

When the ink cartridge is set into the holder, the ink supply hole is connected to the ink introducing portion so that ink is supplied from the ink cartridge to the ink introducing portion through the ink supply hole. Opposite end portions of the filter are thereby filled with ink so that the surface tension of the ink in each fine pore of the filter is destroyed, thereby establishing a state where ink can be supplied from the ink chamber into the ink introducing portion. When the recording head consumes ink, ink is supplied from the ink chamber into the ink introducing portion through the filter and the ink supply hole. When the ink passes through the filter, dust particles and similar material present in the ink are filtered out. The ink chamber is replenished with ink supplied from the ink-impregnated porous member in the foam chamber through the ink passage and, simultaneously, air is introduced into the foam chamber through the atmosphere communicating hole.

Because the ink cartridge includes a filter provided in the ink supply hole, the ink cartridge prevents ink from leaking from the ink supply hole to the outside and prevents air from entering the ink chamber through the ink supply hole when the ink cartridge is not set in the holder. These benefits are accomplished without the need for any other structure in addition to the filter. Therefore, the structure is simplified and requires a reduced number of component members, allowing production of the ink cartridge at low cost. Furthermore, when the ink cartridge is set in the holder so that the ink supply hole connects to the ink introducing portion, ink can be supplied from the ink chamber into the ink introducing portion. The invention thereby facilitates and simplifies the mounting and detaching of the ink cartridge to an from the holder.

The mesh of the plurality of fine pores of the filter may be smaller than the mesh of the plurality of cell pores of the porous member. With such a mesh combination, the resistance to ink passage through the fine pores of the filter is greater than the resistance to ink passage through the cell pores of the porous member. Such an increased ink passage resistance of the filter, in combination with the aforementioned surface tension that occurs in a liquid surface portion of ink in each fine pore of the filter, ensures the prevention of ink leakage from the ink chamber to the outside through the ink supply hole and the filter. Accordingly, ink leakage will be prevented even if a side surface portion of the cartridge case is pressed, causing the interior of the ink cartridge to be pressurized while detached from the holder.

An adapter communicating with the ink supply hole may be fixed to the cartridge case and is connectable to the ink introducing portion. The filter is disposed between the cartridge case and the adapter, and thereby fixed to the cartridge case.

During manufacture of the ink cartridge, the filter can be easily and firmly fixed by disposing the filter between the cartridge case and the adapter and fixing the adapter to the cartridge case. It may be desirable to form the adapter from a synthetic resin. Accordingly, the filter can be mounted by the adapter to the cartridge case from the outside. The adapter can be fixed to the cartridge by, for example, welding. Accordingly, mounting of the filter is simplified and easily accomplished in a manufacturing process.

The ink cartridge may be used in an ink jet recording apparatus that ejects ink to a recording medium for printing. Operation cost of the ink jet recording apparatus can be considerably reduced through the use of the ink cartridge because the disclosed ink cartridge can reliably prevent ink leakage from the ink supply hole to the outside while being produced at reduced cost with a reduced number of component members.

BRIEF DESCRIPTION OF THE DRAWINGS

These and other aspects and advantages of the invention will become apparent from the following detailed description of a preferred embodiment of the invention when taken in conjunction with the accompanying drawings, in which.

DETAILED DESCRIPTION OF PREFERRED EMBODIMENTS

Figure 1:
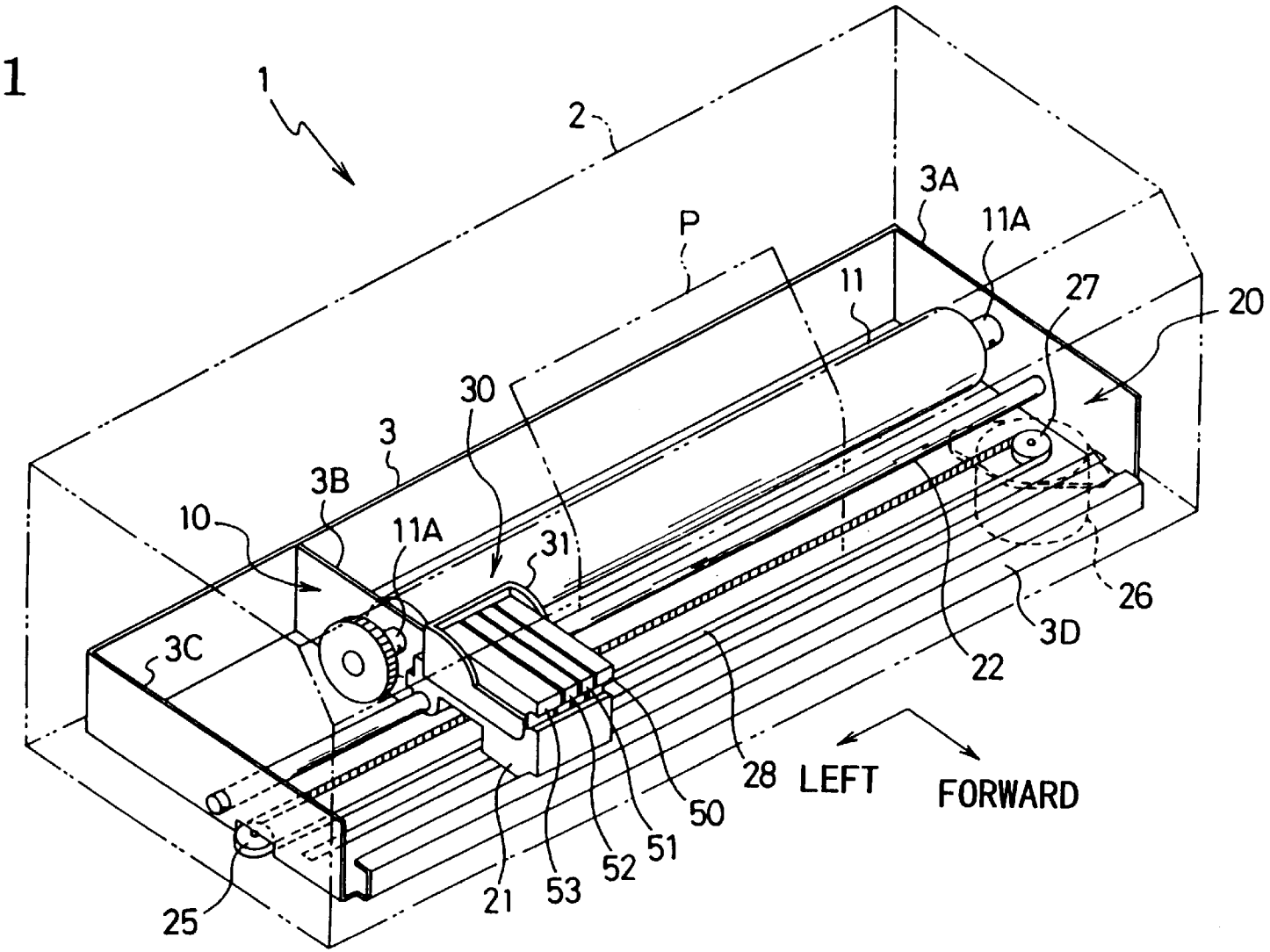
FIG. 1 is a perspective view of an ink jet recording apparatus according to the preferred embodiment of the invention.

While the invention will hereinafter be described in connection with preferred embodiment thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

The preferred embodiment of the invention includes ink cartridges (50–53) that are used for four different colored inks C (cyan), M (magenta), Y (yellow) and K (black) in an ink jet recording apparatus 1. Ink jet nozzles of recording heads eject ink from each of the ink cartridges to record a color image on a recording sheet.

Figure 2:
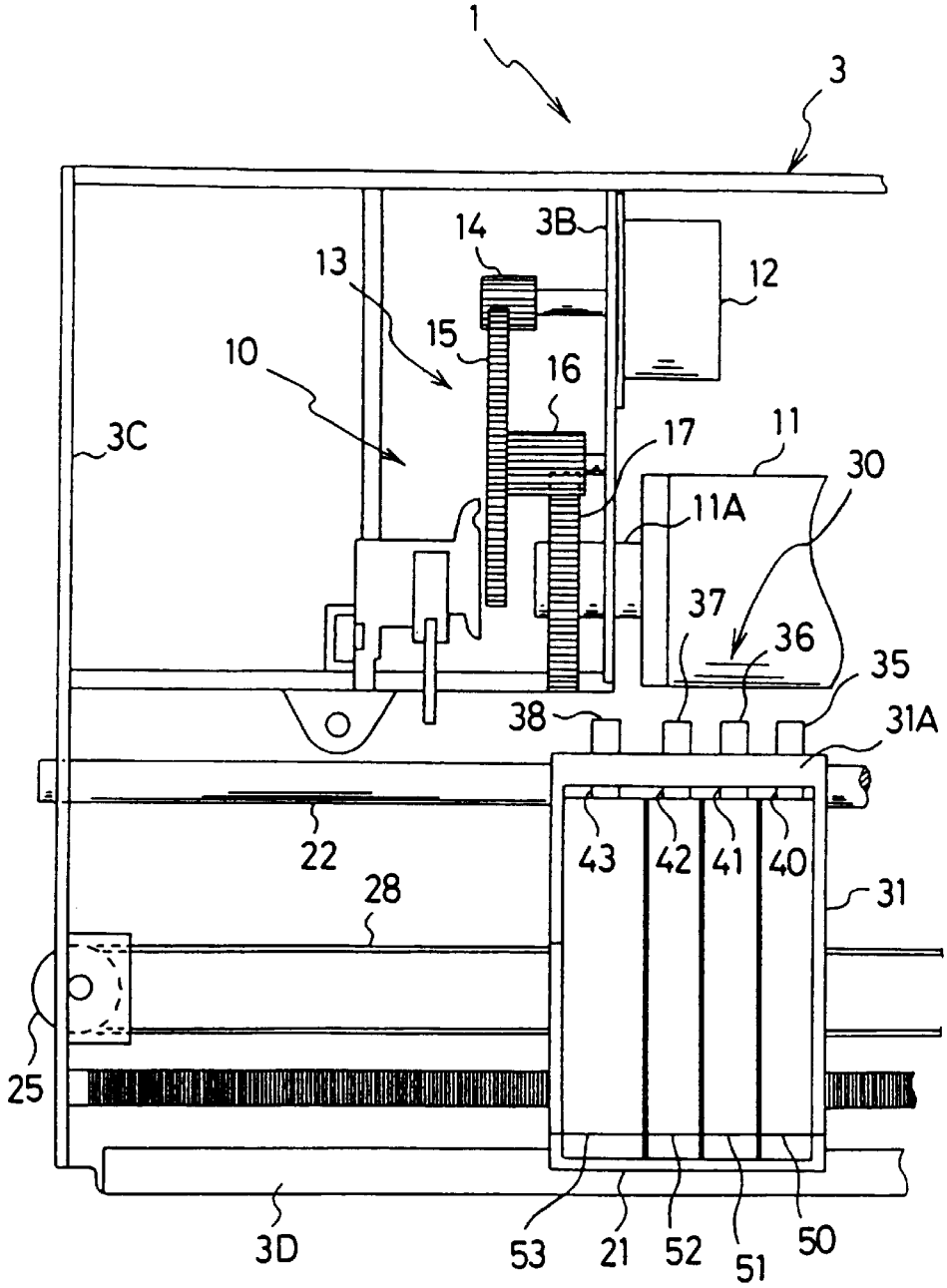
FIG. 2 is a plan view of portions of the ink jet recording apparatus shown in FIG. 1.

FIGS. 1 and 2 show an ink jet recording apparatus 1 including a body frame 3 disposed in a body cover 2. A sheet conveying mechanism 10 is mounted on the body frame 3 and includes a rubber platen 11, a carriage drive mechanism 20 for moving a carriage 21, and an ink jet mechanism 30 for recording a color image on a recording sheet P. A head holder 31 firmly connected to or formed together with an upper portion of the carriage 21 separately holds four ink cartridges 50–53 in a detachable manner.

The sheet conveying mechanism 10 will first be described. The platen 11 is disposed in a right-to-left direction. A platen shaft 11A is rotatably supported at its right and left ends by side wall plates 3A, 3B of the body frame 3. The side wall plate 3B is provided with a feed motor 12. When the feed motor 12 is operated by a control unit (not shown), the platen 11 is rotated through a gear mechanism 13 having gears 14–17.

The carriage drive mechanism 20 will be described next. A guide rod 22 supported at its right and left end portions by the side wall plates 3A and 3C is disposed forwardly of the platen 11, and extends parallel to the platen 11. A guide rail 3D is formed on a front end of the body frame 3 in front of the guide rod 22, extending parallel to the guide rod 22 (and to the platen 11). The carriage 22 is supported by the guide rod 22 and the guide rail 3D so that the carriage 21 is slidable in the right-to-left directions.

A driven pulley 25 is rotatably journaled to the body frame 3 at the left-side end of the moving range of the carriage 21. A stepping motor 26 and a driving pulley 27 connected to an output shaft of the stepping motor 26 are disposed at the right-side end of the moving range of the carriage 21. An endless timing belt 28 connected to the carriage 21 is disposed on the two pulleys 25, 27. When the stepping motor 26 is driven by the control unit (not shown), the carriage 21 is moved in the right-to-left directions.

The recording mechanism 30 will now be described. A holder 31 is firmly connected to or formed together with an upper portion of the carriage 21 and has a generally box-shaped configuration. The holder 31 holds the four ink cartridges 50–53 containing the cyan ink, the magenta ink, the yellow ink and the black ink, respectively in such a manner that the ink cartridges 50–53 can be separately detached from the holder 31. The holder 31 also has a cyan recording head 35, a magenta recording head 36, a yellow recording head 37, and a black recording head 38. The holder 31 also includes a cyan ink introducing portion 40, a magenta ink introducing portion 41, a yellow ink introducing portion 42 and a black ink introducing portion 43.

The recording heads 35–38 are disposed side by side in the moving direction of the carriage 21 at a rear-end upstanding wall portion 31A of the head holder 31. Each recording head 35–38 has, for example, 64 jet nozzles (not shown), and includes structure to eject ink from the jet nozzles by a jet mechanism having piezoelectric elements. The ink introducing portions 40–43 connected to the corresponding recording heads 35–38 and substantially extending through the upstanding wall portion 31A are fixed to the upstanding wall portion 31A. A front end portion of each ink introducing portion 40–43 protrudes forward from the upstanding wall portion 31A. As indicated by broken lines in FIG. 3, the front end of each ink introducing portion 40–43 is connected to a seal adapter 45. When the ink cartridges 50–53 are set into the holder 31, the seal adapters 45 connect with the ink cartridges 50–53.

The ink cartridges 50–53 will now be described. Cartridges 50–53 have the same basic structure. However, the black ink cartridge 53 has a greater width than the other ink cartridges 50–52. Only the ink cartridge 50 is described below.

FIGS. 3–6 show the ink cartridge 50 defined by a cartridge case 60 made from a synthetic resin case body 61 having a lid 62 closing an upper end opening of the case body 61. The case body 61 has a partition 63 extending unitarily from a side wall 61A. The partition 63 divides the interior of the cartridge case 60 into a rearward section and a forward section at a ratio of, for example, 1:8. The rearward section on the rear side of the partition 63 forms an ink chamber 65, and the forward section on the front side of the partition 63 forms a foam chamber 66. The ink chamber 65 contains ink 69 and the foam chamber 66 contains a porous member 68 impregnated with the ink 69. The porous member 68 is formed of, for example, a sponge having continuous pores, or the like.

An ink passage 67 for communication between the ink chamber 65 and the foam chamber 66 is formed in a lower portion of the partition 63 and substantially in the middle of the right-to-left dimension of the partition 63. The ink 69 can move through the ink passage 67 back and forth between the ink chamber 65 and the foam chamber 66. A forwardly-protruding grip portion 70 is formed in an upper front end portion of the cartridge case 60. The ink cartridge 50 may be held by the grip portion 70 when the ink cartridge is set in and detached from the holder 31. The grip portion 70 has a maze-like air passage 71 and an atmosphere communicating hole 72 for communication between the foam chamber 66 and the atmosphere.

Figure 7:
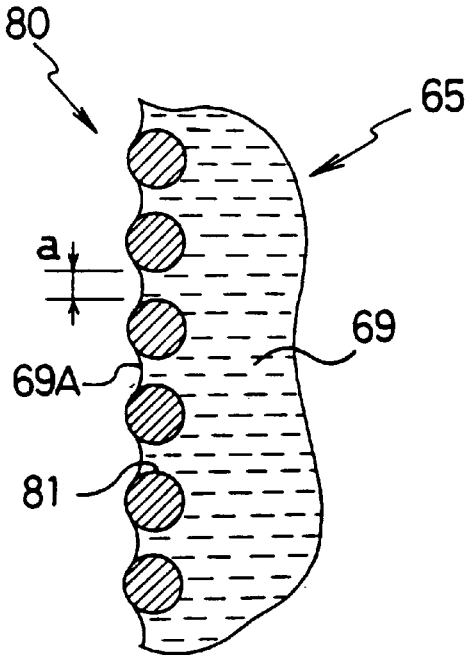
FIG. 7 is an enlarged sectional view of a filter in accordance with the preferred embodiment of the invention showing surface tension occurring in the ink.

An ink supply hole 73 for supplying the ink 69 into the ink introducing portion 40 is formed in an ink chamber-side portion of the cartridge case 60. More specifically, the ink introducing portion 40 is formed in a lower end portion of a rear end side wall 61B of the case body 61. A filter, for example, a stainless steel filter 80, is disposed in a rear end portion of the ink supply hole 73. An adapter 85 communicating with the ink supply hole 73 is fitted into a recess 74 formed in the cartridge case 60, near the rear end of the ink supply hole 73, and welded to the recess 74. As shown in FIG. 7, the filter 80 has many fine pores 81 having a pore diameter a, for example, a=8–16 $\mu$m. The mesh of the filter 80 is smaller than the mesh of the many cell pores of the porous member 68 which has a pore diameter of, for example, 0.3–0.5 mm.

Figure 9:
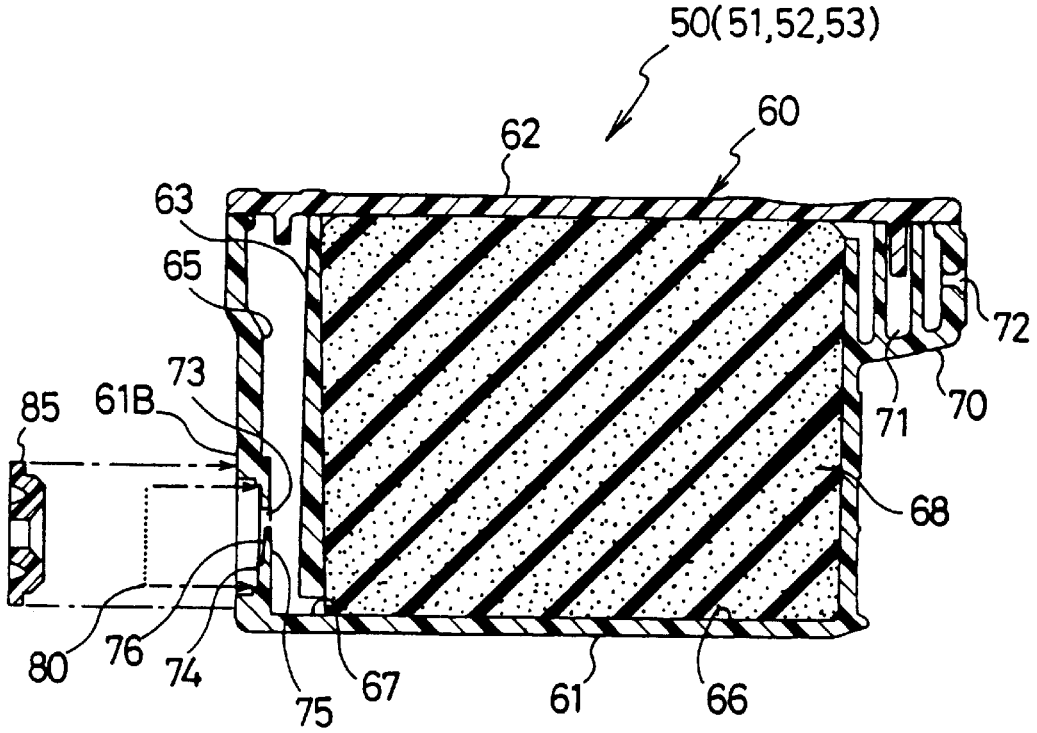
FIG. 9 is an exploded sectional view of the ink cartridge shown in FIG. 3.

The mounting of the filter 80 to the ink cartridge 50 during manufacture of the ink cartridge 50 will now be described. As shown in FIG. 9, the filter 80 is first fitted into the recess 74 formed in the rear end wall 61B of the ink cartridge 50. Subsequently, the adapter 85 is fitted into recess 74, over the filter 80, thereby sandwiching the filter 80 between the adapter 85 and the cartridge case 60. The adapter 85 is then welded to the cartridge case 60, thereby fixing the filter 80. The welding of the adapter 85 to the cartridge case 60 may be accomplished by ultrasonic welding wherein high frequency vibrations are generated to cause friction heat to weld the adapter 85 to the cartridge case 60.

The ink supply hole 73 is provided with an ink guide 75 formed integrally with the ink cartridge 50. The ink guide 75 closes an inner lower portion of the ink supply hole 73. The porous member 68 is compressed and placed in the case body 61 before being impregnated with the ink 69. During manufacture, the ink 69 is supplied into the ink chamber 65 through the ink supply hole 73. During introduction into the ink chamber 65, the ink 69 is guided to an upper portion of the ink chamber 65 by a guide slope 76 formed in an end portion of the ink guide 75. By supplying the ink 69 first to an upper portion of the ink chamber 65, where residual air would likely be left, the ink chamber 65 can be filled with ink 69 without allowing residual air to remain in the ink chamber 65.

The ink supply hole 73 is sealed in a reopenable manner by a peelable adhesive tape or similar material before shipment of the ink cartridge 50, as well known.

Before the ink cartridge 50 is set into the holder 31, the adhesive tape covering the ink supply hole 73 is peeled and an end surface of the filter 80 opposite the surface thereof facing the ink chamber 65 is exposed to the atmosphere as shown in FIG. 7. Due to the atmospheric pressure, surface tension occurs in a liquid surface portion of the ink 69 in each fine pore 81 of the filter 80 so that the surface portion of the ink 69 in each fine pore 81 forms a meniscus (curved liquid surface) 69A, thereby preventing ink leakage from the ink chamber 65 to the outside through the filter 80 and the ink supply hole 73. In addition, if a negative pressure occurs in the cartridge case 60, the surface tension in the liquid surface portion of the ink 69 in each fine pore 81 prevents external air from entering the ink chamber 65 through the filter 80 and ink supply hole 73.

Because the size of the many fine pores 81 of the filter 80 is smaller than the size of the many cell pores of the porous member 68 as described above, the resistance to passage of the ink 69 through the fine pores 81 is greater than the resistance to passage of the ink 69 through the cell pores of the porous member 68. The combination of the increased resistance to ink passage through the fine pores 81 and the surface tension occurring in a liquid surface portion of the ink 69 in each fine pore 81 reliably prevents leakage of the ink 69 from the ink chamber 65 through the ink supply hole 73 even if a side surface portion of the cartridge case 60 is pressed causing pressurization of the interior of the cartridge case 60. Because the air passage 71 and the atmosphere communicating hole 72 are formed in the grip portion 70 and define a large amount of space, the ink 69 in the foam chamber 66 may escape into the air passage 71 but will not leak out if a side surface portion of the cartridge case 60 is pressed when the ink chamber 65 and the foam chamber 66 are full of ink 69.

Figure 3:
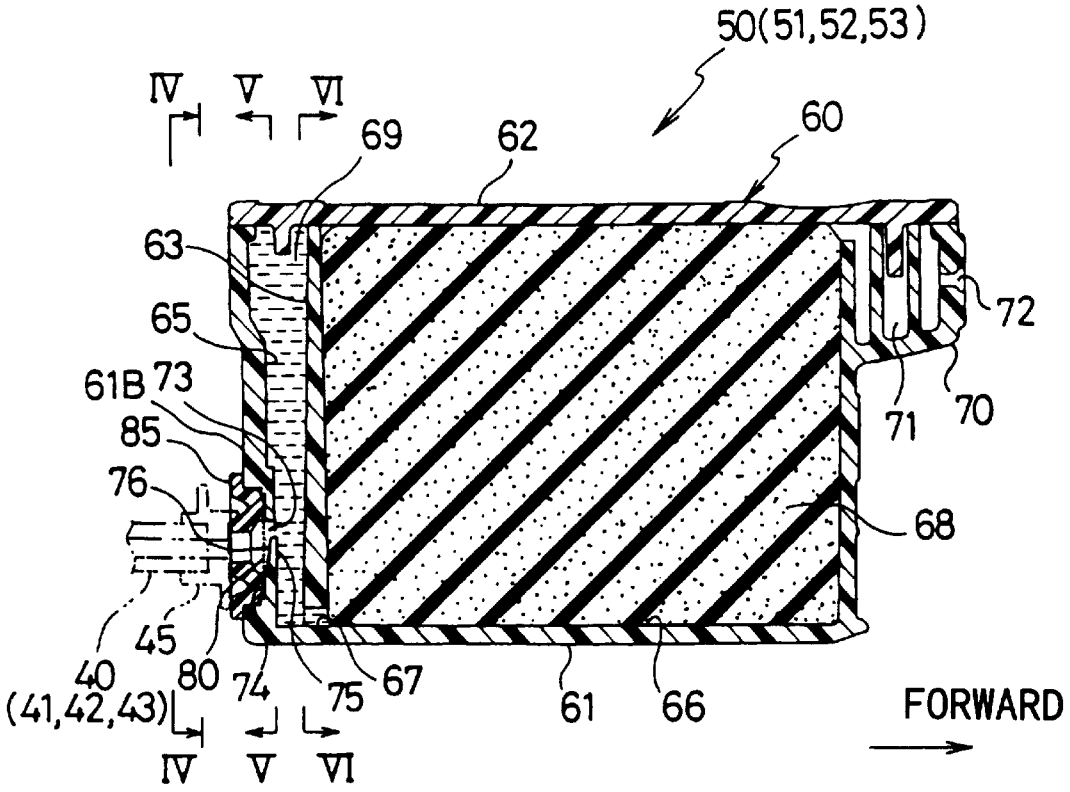
FIG. 3 is a longitudinal sectional view of an ink cartridge in accordance with the preferred embodiment of the invention.
Figure 4:
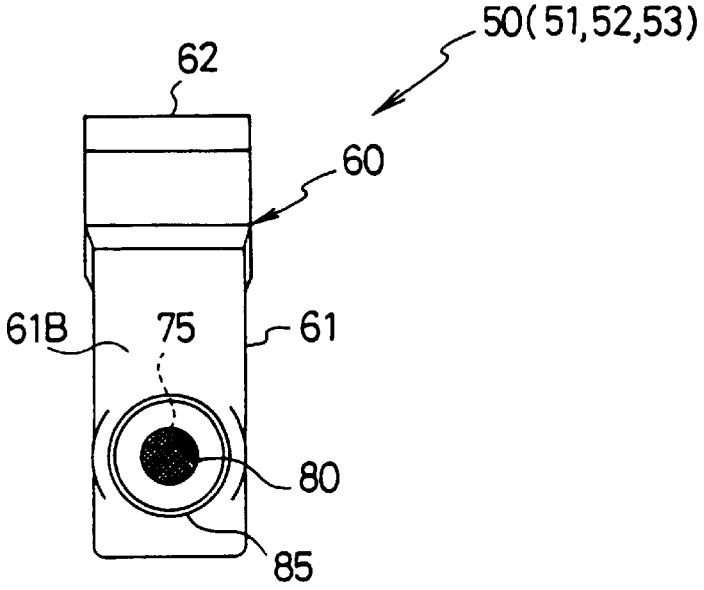
FIG. 4 is a side view of the ink cartridge viewed in the direction indicated by arrows IV—IV of FIG. 3.
Figure 5:
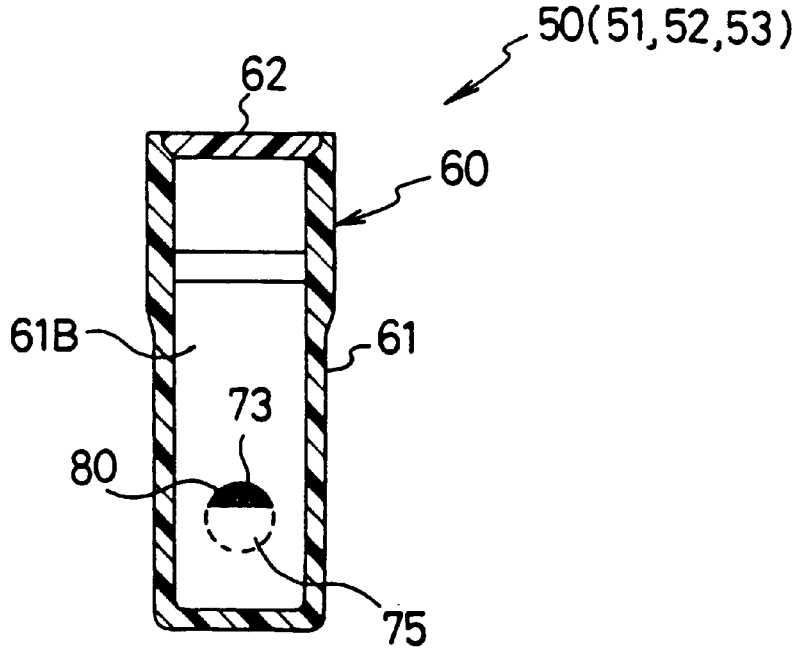
FIG. 5 is a sectional side view of the ink cartridge viewed in the direction indicated by arrows V—V of FIG. 3.
Figure 6:
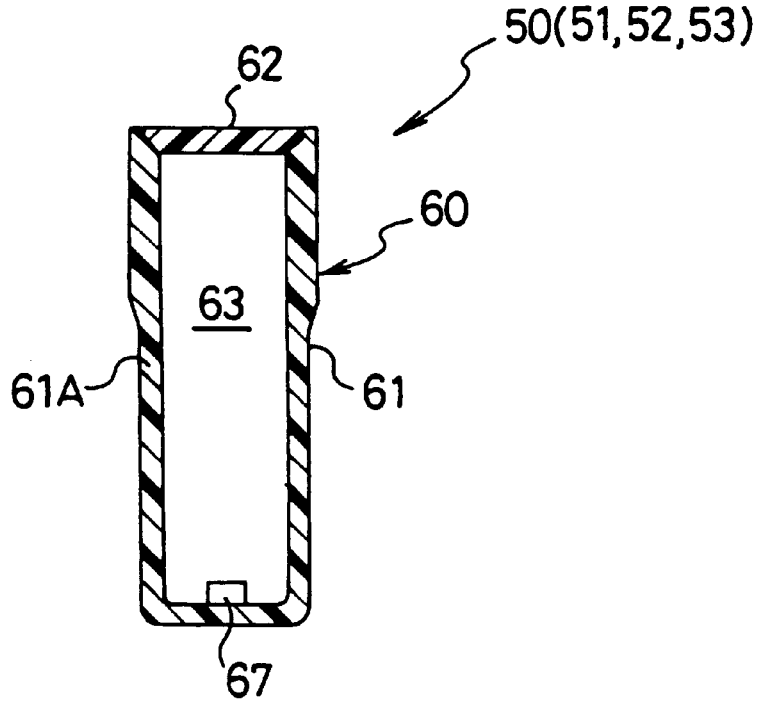
FIG. 6 is a sectional side view of the ink cartridge viewed in the direction indicated by arrows VI—VI of FIG. 3.
Figure 8:
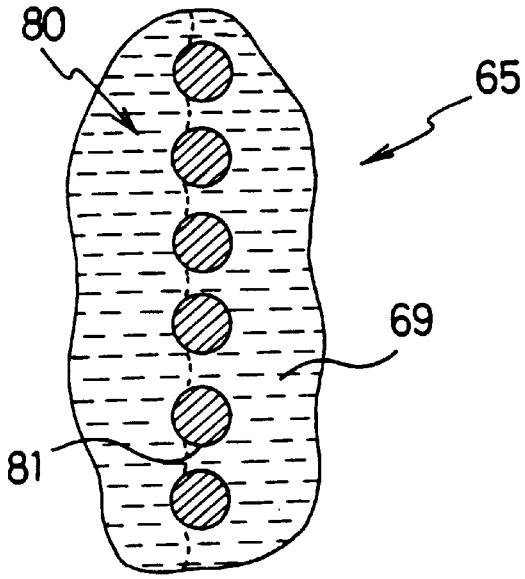
FIG. 8 is an enlarged sectional view of the filter in accordance with the preferred embodiment of the invention showing when it is possible to supply ink to a recording head.

When a new ink cartridge 50 is set into the holder 31, the ink supply hole 73 of the ink cartridge 50 connects to the ink introducing portion 40 of the holder 31 and the adapter 85 of the ink supply hole 73 fits into the seal adapter 45 of the ink introducing portion 40, as shown in FIG. 3. When ink is drawn from the ink cartridge 50 toward the recording head 35 by a suction device (not shown), the ink introducing portion 40 and the recording head 35 are filled with ink 69. The suction from the side of the recording head 35 by the suction device destroys the meniscuses (formed in ink surface portions by surface tension as shown in FIG. 7) so that the ink 69 is supplied from the ink cartridge 50 toward the recording head 35 through the filter 80. The opposite end sides of the filter 80 are thereby filled with the ink 69 as shown in FIG. 8, so that the surface tension in the ink 69 in each fine pore 81 of the filter 80 is eliminated. Accordingly, a state is established where the ink 69 can be supplied from the ink chamber 65 into the ink introducing portion 40.

When the recording head 35 consumes the ink 69 for printing, a corresponding amount of ink 69 is supplied from the ink chamber 65 into the ink introducing portion 40 and into the recording head 35, through the filter 80 and the ink supply hole 73. Dust particles and similar material present in the ink 69 are filtered out when the ink 69 passes through the filter 80. When the amount of the ink 69 in the ink chamber 65 decreases, the ink chamber 65 is replenished with a corresponding amount of ink 69 supplied from the ink-impregnated porous member 68 in the foam chamber 66 through the ink passage 67. Air is correspondingly introduced into the foam chamber 66 through the atmosphere communicating hole 72.

Because the ink cartridge 50 is provided with filter 80 disposed in the ink supply hole 73, the ink cartridge 50 reliably prevents ink leakage from the ink supply hole 73 and also prevents entrance of air into the ink supply hole 73 during detachment and removal of the ink cartridge 50 from the holder 31. No structure other than filter 80 is required to provide the benefits of leak prevention and air entrance. The thus-simplified structure reduces the number of component members required and makes- it possible to produce the ink cartridge 50 at low cost. Furthermore, when the ink cartridge 50 is set into the holder 31, the ink supply hole 73 connects to the ink introducing portion 40 to establish the state in which the ink 69 can be supplied from the ink chamber 65 into the ink introducing portion 40. Therefore, the operation of setting the ink cartridge 50 into the holder 31 and removing it therefrom is streamlined and made considerably more efficient.

Because the mesh of the fine pores 81 of the filter 80 is smaller than the mesh of the cell pores of the porous member 68, the resistance to passage of the ink 69 through the fine pores 81 is greater than the resistance to passage of the ink 69 through the cell pores. A liquid surface portion of the ink 69 in each of the many fine pores 81 of the filter 80 forms a meniscus due to surface tension. Therefore, it is possible to reliably prevent leakage of the ink 69 from the ink chamber 65 to the outside through the filter 80 and the ink supply hole 73 even if a side surface portion of the cartridge case 60 is pressed causing the interior of the cartridge case 60 to be pressurized.

During manufacture of the ink cartridge 50, the filter 80 can be mounted to the cartridge case 60 from the outside. The filter 80 can be easily and reliably fixed by sandwiching the filter 80 between the cartridge case 60 and the adapter 85 and then fixing the adapter 85 to the cartridge case 60. Thus, the mounting and fixing of the filter 80 is uncomplicated and facilitates manufacture of the ink cartridge.

Further, the interior of the cartridge case 60 may be divided into a rear section and a front section at a ratio of 1:8 by the partition 63. Accordingly, the ink chamber 65 formed on the rear side of the partition 63 has a smaller capacity than the foam chamber 66. Thereby, vibrations in the ink 69 in the cartridge case 60 caused by movements of the carriage 31 are minimized to reliably prevent air from moving from the cartridge case 60 into the ink supply hole 73. Accordingly, the ink cartridge 50 provides a stable supply of ink 69 to the recording head 35. Further, the reduced capacity of the ink chamber 65 reduces the deformation of the wall portions of the ink chamber 65 when a side surface of the cartridge case 60 is pressed. Thus, pressurization of the interior of the ink chamber 65 becomes less likely, further preventing leakage of ink from the ink supply hole 73.

The ink cartridge 50 may be applied to the ink jet recording apparatus 1 that ejects the ink 69 to a recording sheet P. Ink leakage from the ink cartridge 50 and the resultant staining of the ink jet recording apparatus will be substantially prevented when the disclosed ink cartridge is used. Further, because the ink cartridge 50 can be produced at low cost, the operating cost of the ink jet recording apparatus 1 can be remarkably reduced.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An ink cartridge detachably mountable to a holder having an ink introducing portion for introducing ink into a recording head, comprising:

a cartridge case having an ink chamber for holding ink, a foam chamber holding a porous member that can be impregnated with ink, and an ink passage for communication between the ink chamber and the foam chamber, the ink chamber having an ink supply hole for supplying ink to the ink introducing portion of the holder, the foam chamber having an atmosphere communicating hole for allowing the foam chamber of the cartridge case to communicate with atmosphere;

a filter provided in the ink supply hole; and an adapter fixed to the cartridge case, said adapter integrally communicating with the ink supply hole and connectable to the ink introducing portion, wherein the filter is disposed between the cartridge case and the adapter and the filter is fixed to the cartridge case by the adapter.

2. The ink cartridge according to claim 1, wherein a pore size of a plurality of fine pores of the filter is smaller than a pore size of a plurality of cell pores of the porous member.

3. An ink cartridge according to claim 1, wherein the ink cartridge is applicable to an ink jet recording apparatus that ejects ink to a recording medium for printing.

4. An ink cartridge detachably mountable to a holder having an ink introducing portion for introducing ink into a recording head, comprising:

a cartridge case for holding ink therein, the cartridge case having an ink supply hole configured for supplying ink into the ink introducing portion of the holder, the cartridge case also having an atmosphere communicating hole for opening the cartridge case to the atmosphere;

a filter located in the ink supply hole and insertable into the ink supply hole from outside of the cartridge case; and an adapter fixed to the cartridge case, said adapter integrally communicating with the ink supply hole, wherein the filter is disposed between the cartridge case and the adapter and the filter is fixed to the cartridge case by the adapter.

5. The ink cartridge according to claim 4, wherein the filter includes a plurality of pores that are sized such that ink forms a meniscus due to surface tension when the ink supply hole is exposed to atmosphere.

6. The ink cartridge according to claim 4, wherein the filter includes a plurality of filter pores and the cartridge case includes a foam chamber and a porous member comprising a plurality of porous member pores, which are larger than the filter pores, located in the foam chamber for storing ink in the foam chamber.

7. The ink cartridge according to claim 4, further comprising a grip portion, wherein the atmosphere communicating hole is formed in the grip portion of the cartridge case and the grip portion includes a maze-like air passageway for allowing an interior of the cartridge case to communicate with the atmosphere while preventing leakage of ink from the cartridge case.

8. An ink cartridge for supplying ink to a printing device comprises:

a cartridge case having an ink chamber including an outlet opening in the cartridge case, the outlet opening being connectable to the printing device for outletting ink to the printing device;

ink stopping means located in the outlet opening for outletting ink to the printing device when the outlet opening is connected to the printing device, for preventing ink from escaping from the outlet opening when the outlet opening is not connected to the printing device; and an adapter fixed to the cartridge case, the adapter integrally communicating with the outlet opening, wherein the ink stopping means is disposed between the cartridge case and the adapter and the ink stopping means is fixed to the cartridge case by the adapter.

9. The ink cartridge according to claim 8, wherein the ink stopping means includes a filter.

10. The ink cartridge according to claim 9, wherein the filter includes a plurality of pores that are sized such that ink forms a meniscus due to surface tension when the outlet opening is open to atmosphere.

11. The ink cartridge according to claim 8, further comprising ink guiding means, located in the outlet opening for directing ink to a top of the ink chamber when ink is being loaded into the ink chamber.

12. The ink cartridge according to claim 8, wherein the cartridge case includes a foam chamber and a communication opening for allowing ink to communicate between the ink chamber and the foam chamber.

13. The ink cartridge according to claim 12, wherein the cartridge case includes a porous member located in the foam chamber for retaining ink in the foam chamber.

14. The ink cartridge according to claim 13, wherein the ink stopping means includes a filter having a plurality of filter pores, the porous member includes a plurality of porous member pores, and the filter pores are smaller than the porous member pores.

15. The ink cartridge according to claim 14, wherein the filter pores have a pore diameter of about 8–16 $\mu$m.

16. The ink cartridge according to claim 14, wherein the porous member pores have a pore diameter of about 0.3–0.5 mm.

17. The ink cartridge according to claim 12, wherein the ink stopping means includes a filter having a plurality of filter pores that are sized such that ink forms a meniscus due to surface tension when the outlet opening is open to atmosphere.

18. A method for making an ink cartridge for supplying ink to a printing device, comprising the steps of:

providing a cartridge case having an ink chamber;

forming an outlet opening in the ink chamber for outletting ink to the printing device;

placing a filter into the outlet opening from a position outside of the cartridge case; and placing and integrally affixing an adapter for connection to the printing device over the filter to sandwich the filter between the adapter and the cartridge case.

* * * * *